US006357149B1

(12) United States Patent
Satzler

(10) Patent No.: US 6,357,149 B1
(45) Date of Patent: Mar. 19, 2002

(54) METHOD AND APPARATUS FOR DETERMINING THE DEPTH OF ACCEPTABLE SEDIMENT REMOVAL FROM A BODY OF WATER

(75) Inventor: Ronnie L. Satzler, Princeville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/529,753

(22) PCT Filed: Mar. 24, 2000

(86) PCT No.: PCT/US00/07954

§ 371 Date: Apr. 18, 2000

§ 102(e) Date: Apr. 18, 2000

(51) Int. Cl.[7] ..... E02F 1/00
(52) U.S. Cl. ..... 37/307; 405/17
(58) Field of Search ..... 37/91–93, 189, 37/307–309, 337, 338, 347, 348, 350–355, 901, 322, 323; 172/39, 55, 559; 405/17–34

(56) References Cited

U.S. PATENT DOCUMENTS 5,032,794 A 7/1991 Ridd et al.
5,604,582 A 2/1997 Rhoads et al.
5,660,055 A 8/1997 Eriksson
5,775,836 A 7/1998 Dean, Jr.
5,907,915 A 6/1999 Satzler
5,960,570 A 10/1999 Satzler
5,903,989 A 5/2000 Satzler

*Primary Examiner*—Robert E. Pezzuto
(74) *Attorney, Agent, or Firm*—Blackwell Sanders Peper Martin, LLP

(57) ABSTRACT

The depth of sediment material under a body of water having a minimum desirable consistency or strength for a dredging operation is determined by an arm assembly having one end portion pivotally connected to a substantially horizontal platform, and a plate member associated with the opposite end having a predetermined cross-sectional area for encountering a resistance force from the sediment material and causing the arm assembly to pivotally rotate relative to the horizontal member. A mechanism exerts a biasing force on the arm assembly which acts against the resistance force of the sediment material. The arm assembly achieves an equilibrium position determining the depth of the sediment material having a minimum desirable consistency or strength for a particular dredging operation.

20 Claims, 4 Drawing Sheets

DREDGING APPARATUS
10
56
ECM
40
38
50
SENSOR
36
PLATFORM POSITIONING MEANS
22

METHOD AND APPARATUS FOR DETERMINING THE DEPTH OF ACCEPTABLE SEDIMENT REMOVAL FROM A BODY OF WATER

TECHNICAL FIELD

This invention relates generally to the removal of sediment material from a body of water and, more particularly, to a method and apparatus for determining the depth of sediment material having a minimum desirable consistency or strength acceptable for removal from under a body of water via a dredging operation.

BACKGROUND ART

Various types of dredging equipment designed to remove sediment material from the bottom of a body of water are well known in the art. Such known dredging apparatus are usually designed to remove sediment from the floor of a body of water by excavating material at a particular predetermined depth below the surface of the water through the use of one or more excavating wheel assemblies. One such dredging apparatus is disclosed in U.S. Pat. No. 5,960,570.

The depth and consistency or strength of sediment material underneath a body of water are typically irregular and inconsistent as the floor surface of a particular body of water varies continually. Also, the consistency or strength of the sediment material to be removed normally varies as a function of depth below the surface of the floor, the upper portion or upper level of the sediment material at the floor surface having a very fine consistency or low strength. Given the costs associated with excavating, lifting and transporting removed material, it is desirable to remove sediment material having a higher consistency or strength, that is, material with higher silt or sediment content and lower water content. Therefore, material having a minimum consistency desirable for removal typically does not exist at the floor surface, but instead, such material typically exists at some depth below the floor surface of the body of water and that acceptable depth level usually varies throughout the terrain of the floor.

It is therefore desirable to accurately determine the depth of sediment material having a minimum desirable consistency throughout the floor surface of a body of water in order to adjust and control the depth of sediment removal during a dredging operation.

Accordingly, the present invention is directed to overcoming one or more of the problems as set forth above.

DISCLOSURE OF THE INVENTION

In one aspect of this invention, an apparatus adapted for determining the depth of sediment material under a body of water having a minimum desirable consistency for a dredging operation is disclosed. The apparatus includes an arm assembly having opposed end portions, one end portion of the arm assembly being pivotally attached to a substantially horizontal member, a plate member associated with the opposite end portion of the arm assembly, the plate member having a predetermined cross-sectional area for encountering a resistance force from the sediment material located under the body of water when the plate member is moved thereacross, the resistance force from the sediment material causing the arm assembly to pivotally rotate relative to the substantially horizontal member, force means adapted to exert a biasing force on the arm assembly which acts against the resistance force of the sediment material, and the arm assembly achieving an equilibrium position when the biasing force equals the resistance force of the sediment material, the equilibrium position of the arm assembly determining the depth of the sediment material having a minimum desirable consistency for a dredging operation.

In another aspect of this invention, a method for determining the depth of sediment material having a minimum desirable consistency under a body of water wherein a dredging apparatus is used to remove the sediment material from under the body of water, the dredging apparatus having a frame structure and a dredging wheel mechanism associated therewith. The method includes the following steps of providing an arm assembly having opposed end portions, providing a substantially horizontal member for attaching to the dredging apparatus, pivotally mounting the arm assembly to the substantially horizontal member, providing a plate member associated with the opposite end portion of the arm assembly, the plate member having a predetermined cross-sectional area for encountering a resistance force from the sediment material when the plate member is moved thereacross, the resistance force from the sediment material causing the arm member to pivotally rotate relative to the substantially horizontal member, moving the arm assembly across the sediment material located under the body of water, applying a force on the arm assembly opposing the resistance force exerted on the plate member by the sediment material, the arm assembly achieving an equilibrium position when the opposing force equals the resistance force of the sediment material, the equilibrium position determining the depth of the sediment material having a minimum desirable consistency for a dredging operation, sensing the angular position of the arm assembly relative to a predetermined referenced orientation when the arm assembly is in its equilibrium position, and determining the depth of the equilibrium position of the arm assembly with respect to the frame structure of the dredging apparatus based upon the sensed angular position of the arm assembly at its equilibrium position.

BRIEF DESCRIPTION OF THE DRAWINGS

For a better understanding of the present invention, reference may be made to the accompanying drawings in which.

BEST MODE FOR CARRYING OUT THE INVENTION

Figure 1:
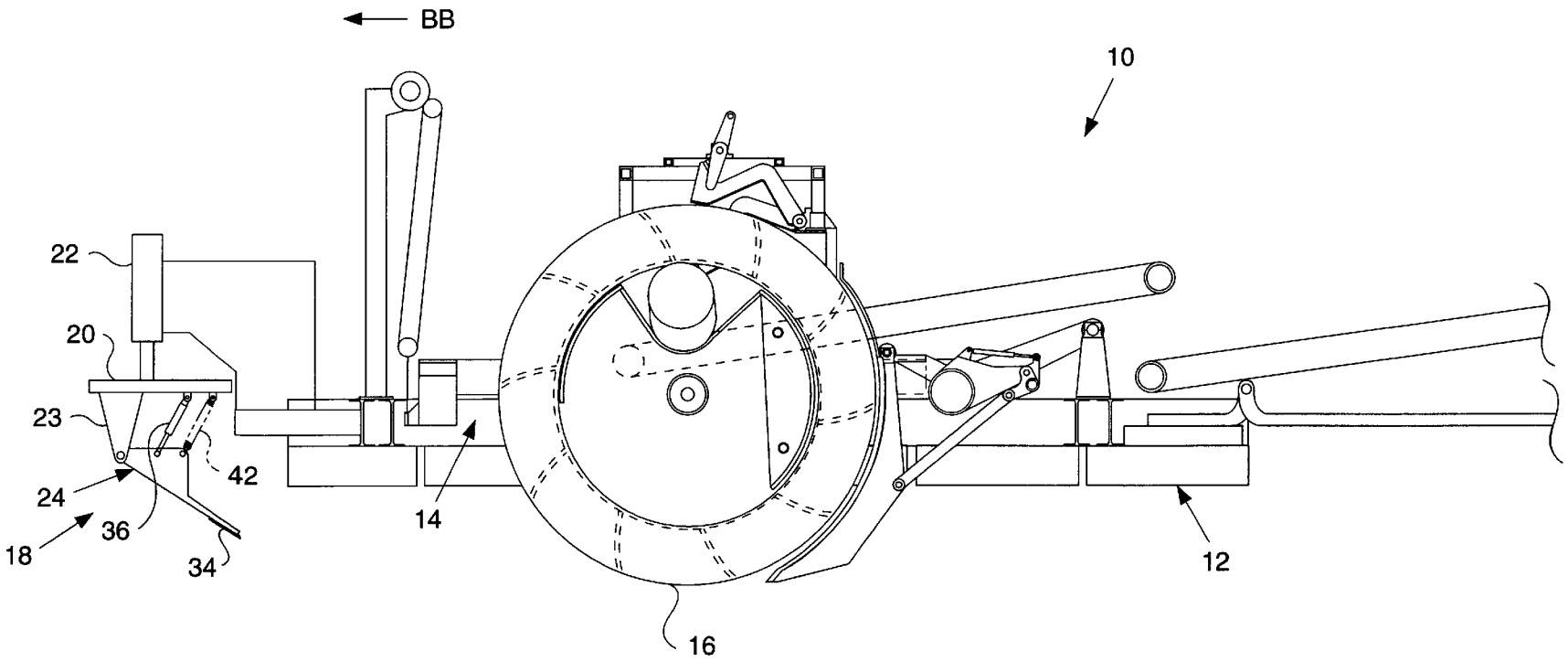
FIG. 1 is a side elevational view of a typical dredging apparatus incorporating the present invention.

Referring to the drawings and more particularly to FIG. 1, a dredging apparatus 10 is provided and adapted to remove sediment material from under a body of water. Apparatus 10 includes a floatation arrangement 12, a frame arrangement 14 connected to floatation arrangement 12, a dredging wheel mechanism 16 connected to frame arrangement 14 operative to excavate and remove sediment material at a desirable depth under the body of water, a horizontal platform 20 adjustably connected to frame 14, and an arm assembly mechanism 18 connected to platform 20 and operable as will be hereinafter discussed. Apparatus 10 is capable of locomotion by virtue of a propulsion system (not shown) which typically includes a pair of independent drive wheel assemblies or spade wheels which are controllably operable to propel and navigate the dredging apparatus 10 on the body of water. The propulsion system is operative in a well known manner.

In one embodiment of the present invention, a horizontal platform 20 is adjustably connected to frame arrangement 14. The vertical position of platform 20 is preferably vertically adjustable with respect to the surface of the water while maintaining its substantially horizontal position by an adjustment means 22 such as a fluid actuated cylinder, as depicted in FIG. 1. This is advantageous in order to accommodate bodies of water having different average floor depths. The vertical position of platform 20 is typically adjusted according to the average floor depth of the body of water in which dredging apparatus 10 will be operative, and such position is such that the overall length of arm assembly 24 attached thereto is sufficient to engage the floor surface of the body of water and locate the depth or dividing line between acceptable and unacceptable sediment strength or consistency. Although it is preferred that the position of platform 20 remain fixed for the duration of a particular dredging operation, it is also recognized that this position can be adjusted during a particular dredging operation due to the varying depth of the floor surface associated with a particular body of water. It is also recognized and anticipated that other adjustment means may likewise be utilized for adjusting the vertical position of platform 20 and, for certain applications, it is also recognized that the vertical position of platform 20 may be fixed instead of adjustable.

Figure 2:
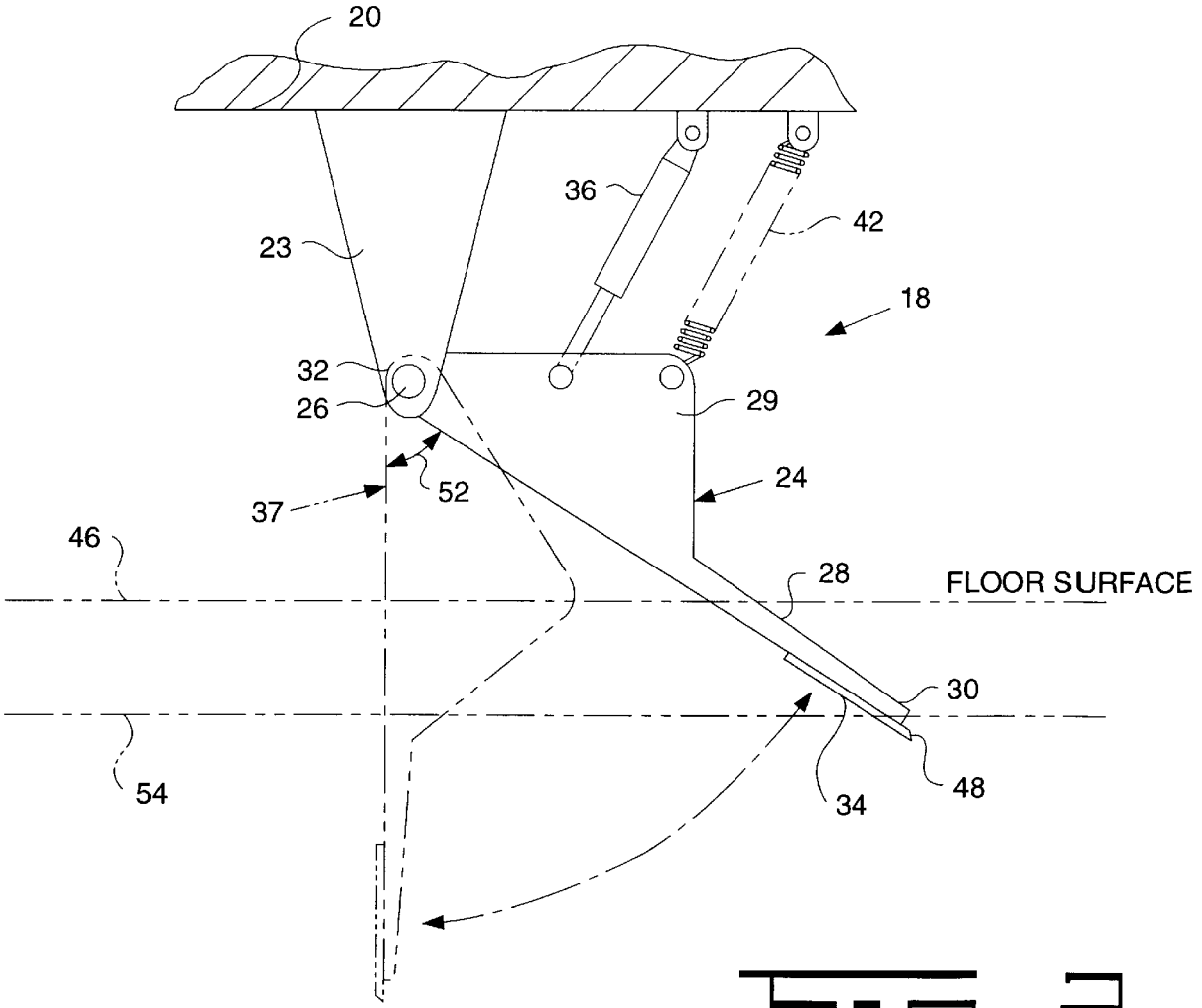
FIG. 2 is an enlarged partial side view of the platform and arm assembly illustrated in FIG. 1, the arm assembly being shown in a first biased substantially vertical position in phantom outline form and in a second pivoted equilibrium position in solid outline form.

Referring to FIG. 2, in one embodiment of the present invention platform 20 includes a bracket 23 substantially rigidly connected thereto. Bracket 23 preferably extends vertically downward towards the body of water and has an arm assembly 24 pivotally connected thereto at pivot point 26. Those skilled in the art will appreciate that bracket 23 may be eliminated and arm assembly 24 may be pivotally connected directly to platform 20. It is also recognized that other means for extending pivot point 26 from platform 20 for connection to arm assembly 24 may be utilized and it is intended that the claims shall cover all such embodiments that do not depart from the spirit and scope of the present invention.

Figure 3:
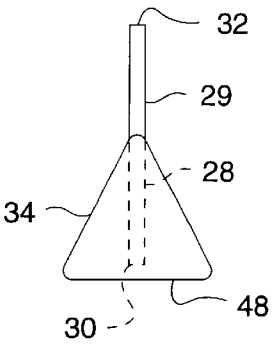
FIG. 3 is a front elevational view of one embodiment of the plate member illustrated in FIG. 2.

Arm assembly 24 preferably includes a relative narrow longitudinal portion 28 and a relatively wider portion 29, the arm assembly 24 having opposed ends 30 and 32 as best shown in FIG. 3. In one embodiment of the present invention, end portion 32 of arm assembly 24 is pivotally connected to bracket 23 at pivot point 26 and end portion 30 includes a plate member 34 having a desired or predetermined cross-sectional shape and area associated therewith, the plate member 34 being substantially rigidly connected to longitudinal portion 28 of arm assembly 24 as shown in FIGS. 2 and 3. In this regard, plate member 34 is connected to arm assembly 24 such that the cross-sectional area thereof is substantially perpendicular to the direction of pivot of arm assembly 24. The shape and planar area of plate member 34 determines, in part, the amount of resistance force exerted thereagainst which will move arm assembly 24 to a depth level within the sediment wherein an acceptable sediment strength or consistency is located. In the embodiment illustrated in FIG. 3, plate member 34 is substantially triangular in shape, although it is recognized and anticipated that the shape and size of plate member 34 may be different and may be customized to the requirements of a particular dredging application.

Figure 5:
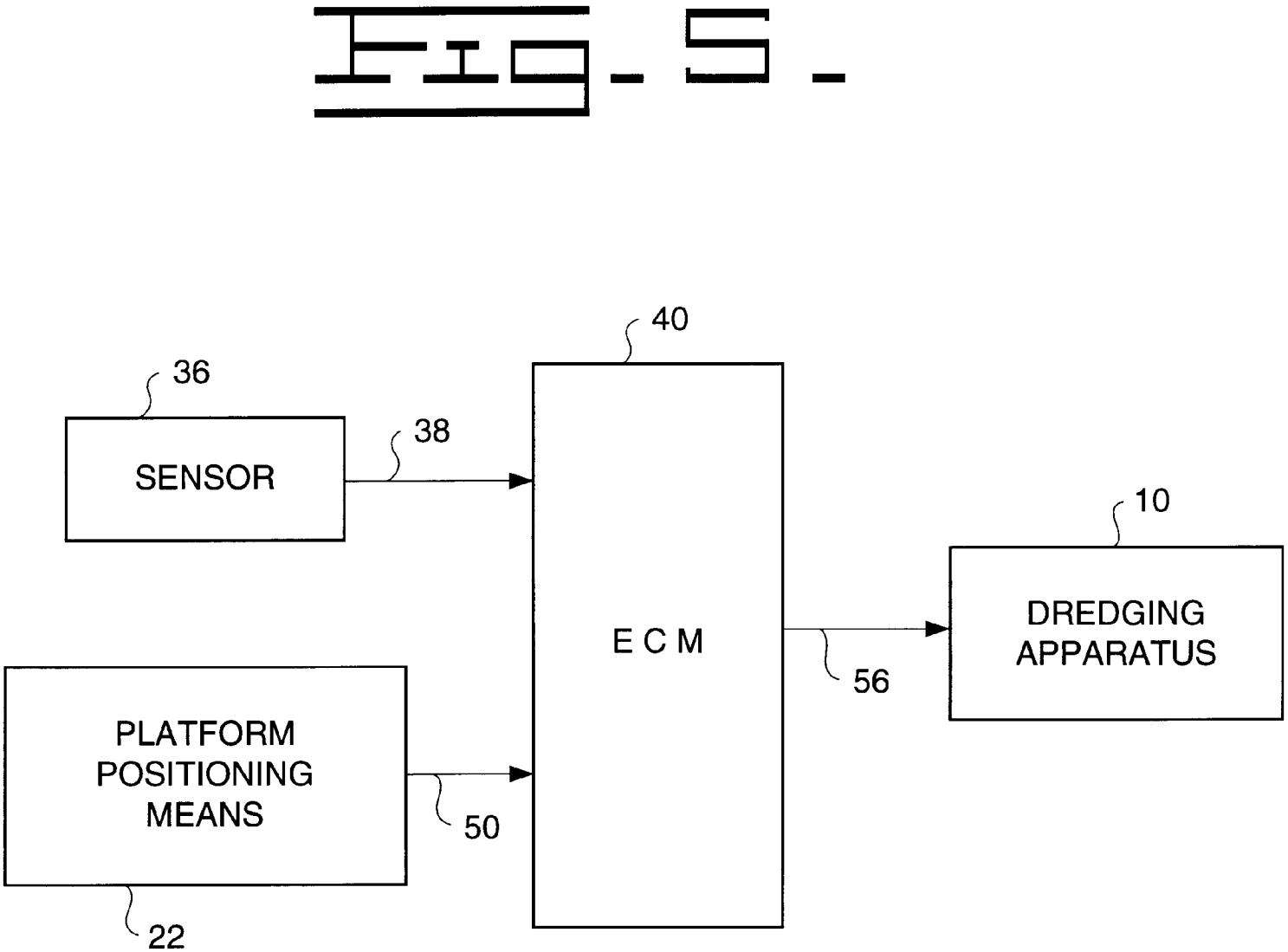
FIG. 5 is a schematic illustration of one embodiment of an electronic control system constructed in accordance with the teachings of the present invention.

In another aspect of the present invention, a position sensing means 36 is connected or otherwise coupled between platform 20 and arm assembly 24 to sense the angular position of pivotable arm assembly 24 relative to its vertical biased position 37 as shown in FIG. 2. Those skilled in the art will appreciate that any position sensing means known in the art may be utilized to sense the angular position of arm assembly 24 relative to a particular reference location such as relative to the substantially vertical biased position 37. Position sensing means 36 preferably emits a signal 38 indicative of the angular position of arm assembly 24 to an electronic control module (ECM) 40 preferably coupled thereto as shown in FIG. 5. The purpose and functioning of ECM 40 will be hereinafter discussed.

An adjustable force applying means 42 is also connected or otherwise coupled between platform 20 and arm assembly 24. Force applying means 42 may be any type of mechanical device used in the art for applying a force upon a body such as a coiled spring, a compression spring, a fluid actuated cylinder programmed with a predetermined cylinder pressure, and a wide variety of other known biasing means. Force or biasing means 42 preferably biases the angular position of arm assembly 24 in a substantially vertical position as depicted in phantom outline form at 37 in FIG. 2. Further, force or biasing means 42 preferably creates and exerts a resistance force against any force acting upon plate member 34 and arm assembly 24 in the direction indicated by arrow AA in FIG. 2. The amount of force exerted by force means 42 is preferably adjustable whereby the present invention may be utilized in bodies of water having varying sediment material consistencies at and beneath their respective floor surfaces. The amount of force exerted by force means 42 in conjunction with the planar area of plate member 34 determines the amount of resistance force necessary to achieve the desired equilibrium level for determining the proper sediment depth at which a minimum acceptable or desired consistency is located. In this regard, it is recognized and anticipated that force means 42 may exert a fixed predetermined amount of force instead of having an adjustable force capability. The biasing force exerted by force means 42 is preferably fixed for a particular dredging operation across the entire floor surface of a particular body of water, which force may be determined as hereinafter discussed. It is also recognized and anticipated that the force exerted by the force means 42 may be varied during a dredging operation as a function of the depth of the floor surface or another desirable criteria.

As the dredging apparatus 10 moves in the direction shown by Arrow BB in FIGS. 1 and 2, plate member 34 encounters a resistance force from sediment material under the body of water, which force pushes against the surface area of plate 34. Such force causes the arm assembly 24 to pivot about pivot point 26 in a counterclockwise direction in the side view of the embodiment depicted in FIG. 2. Such counterclockwise motion of arm assembly 24, however, is resisted and opposed by the force exerted by force or biasing means 42. Essentially, therefore, two opposing forces simultaneously act upon arm assembly 24, namely, the resistance force generated by the sediment material and the biasing force of force means 42. As a result, arm assembly 24 automatically attains an equilibrium position whereat the two opposing forces substantially counteract each other. Based upon the biasing force exerted by force means 42 and the surface area associated with plate member 34, this equilibrium position of arm assembly 24 and, particularly, the location of the bottom edge portion 48 of plate member 34, determines the depth of acceptable sediment consistency or strength for removal by a dredging operation. An example of arm assembly 24 at such an equilibrium position is depicted in solid outline in FIG. 2. At such equilibrium position, position sensing means 36 senses the angular position of arm assembly 24 relative to the vertical such as angle 52 illustrated in FIG. 2 and emits a signal indicative thereof to ECM 40.

Those skilled in the art will appreciate that as apparatus 10 moves in the direction of arrow BB, the equilibrium position achieved by arm assembly 24 will also vary as a function of the depth of the floor surface 46 beneath the body of water and the consistency of sediment material thereunder. Accordingly, position sensor 36 is preferably designed to sense the position of arm assembly 24 continuously in order for ECM 40 to determine and record the equilibrium position of arm assembly 24 as it moves across the floor surface 46 of a particular body of water.

Typically, the consistency of sediment material increases as a function of depth under the floor surface 46 of a body of water. Accordingly, the sediment material lying at floor surface 46 has a low consistency or strength, that is, the ratio of silt or sediment material versus water content is low, and is usually not desirable for removal. Material having a desirable consistency is usually present at some level or depth beneath the floor surface 46 of a body of water.

Figure 4:
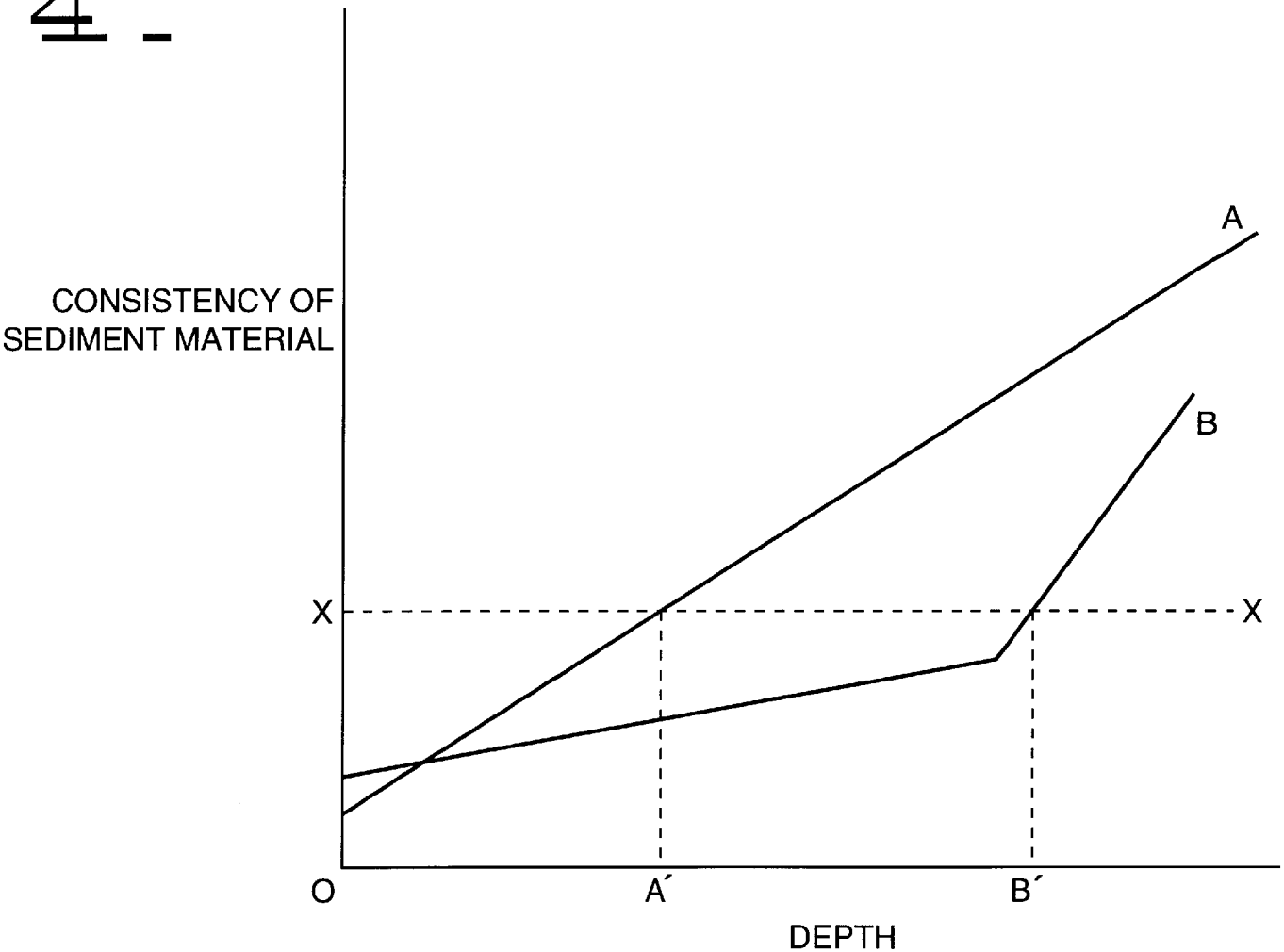
FIG. 4 is a graphical illustration showing the relationship between the strength or consistency of sediment material in a body of water versus the depth of such material for two different types of sediment.

In this regard, the graph of FIG. 4 graphically illustrates the consistency of sediment material as a function of depth in two example bodies of water. In example A, the consistency of sediment material increases in linear proportion to the sediment depth and line X marks the minimum desirable sediment consistency for removal by a dredging operation. This minimum desirable sediment consistency or strength occurs at a depth A' in Example A of FIG. 4. Similarly, in example B, the consistency of sediment material increases with sediment depth, although the relationship therebetween is non-linear. As shown, sediment material having a minimum desirable consistency in example B exists at a depth B'. Those skilled in the art will appreciate that such graphical relationship between the strength or consistency of sediment material and depth will typically vary for different bodies of water and such relationship can usually be determined, or at least approximated, through experimentation, analysis and/or research regarding the particular body of water.

Upon thus determining the depth below the floor surface 46 of a particular body of water where sediment material having desirable consistency exists, the biasing force associated with force means 42 may be adjusted accordingly keeping in mind the surface area of plate member 34 such that arm assembly 24 will achieve an equilibrium position when the lower or bottom end portion 48 of plate member 34 reaches the appropriate sediment depth as illustrated in FIG. 2. Those skilled in the art will appreciate that the lower consistency sediment material closer to the floor surface 46 will exert lesser force upon plate member 34 as compared to the comparatively higher consistency sediment material located underneath, whereby the force exerted upon plate member 34 by the sediment material will increase as a function of depth. The biasing force of force means 42 may therefore be adjusted to be a greater force depending upon the minimum consistency of material desired for removal from a particular body of water.

Referring to FIG. 5, position sensing means 36 is coupled to ECM 40 and senses the angular position of arm assembly 24. Once the angular position of arm assembly 24 is sensed, sensor 36 emits a signal 38 indicative thereof to ECM 40. Electronic controllers or modules such as ECM 40 are commonly used in association with machines and apparatus for calculating values or controlling various functions and tasks including monitoring and controlling a wide variety of mechanical functions such as engine speed, torque on a pulley, the speed of motors, and so forth. Controllers and electronic modules such as ECM 40 are typically utilized for delivering signals to devices such as pumps, hydraulic cylinders, motor controllers, and a wide variety of other mechanical components to control the operation of a particular device or component associated therewith, or to provide a data output thereto, indicative of a particular calculated or desirable value. However, they may also be used to collect data and preserve it in a memory means or a data recordation means associated therewith. In this regard, ECM 40 will typically include processing means such as a microcontroller or microprocessor, associated electronic circuitry such as input/output circuitry, analog circuits, digital circuits, programmed logic arrays, associated memory means, disk drives, and other data recordation or peripheral devices.

Based upon the angular position of arm assembly 24 at an equilibrium position, ECM 40 can determine the vertical depth of end portion 48 of arm assembly 24 relative to platform 20 and frame arrangement 14 because all other variables for determining such depth should be known and available to ECM 40 by being stored in an associated memory means or data recordation means, or by being programmed into the associated software therefor. The vertical position of platform 20 is adjustable, and preferably remains constant during a dredging operation in a particular body of water. Such vertical position relative to frame 14 is either manually set and known by the operator, or such position is preferably sensed by platform adjustment or positioning means 22 which preferably emits a signal 50 indicative thereof to ECM 40 as illustrated in FIG. 5. However, those skilled in the art will appreciate that if platform adjustment means 22 is not utilized, the vertical position of platform 20 may also be inputted to ECM 40 by one of various other methods known in the art including manual entry by an operator through a wide variety of known input devices. Further, the length of bracket 23 is also fixed such that the distance between pivot point 26 and end portion 48 of plate member 34 on arm assembly 24 may be predetermined or measured and likewise inputted or otherwise provided to ECM 40. Finally, while arm assembly 24 is in an equilibrium position as illustrated in solid outline form in FIG. 2, the angle which arm assembly 24 makes relative to the vertical may be determined by virtue of signal 38 from position sensing means 36. Such angle is referenced by the number 52 in FIG. 2.

The only value that remains to be determined for calculating the depth of material having a minimum desired consistency under a body of water is the vertical distance between pivot point 26 and the point C illustrated in FIG. 2, which point C represents the horizontal projection of end portion 48 of plate member 34 into the vertical reference plane. Line 54 in FIG. 2 represents a horizontal line extending from end portion 48 of plate member 34 to point C on the vertical reference plane. It can be seen that the aforementioned distances and lines form a right angled triangle wherein the distance between pivot point 26 and end portion 48 of plate member 34 represents the hypotenuse, the vertical distance between pivot point 26 and point C on horizontal line 54 represents the height, and the horizontal distance between point C and end portion 48 of plate member 34 along horizontal line 54 represents the base of the triangle. Since the length of the hypotenuse of the right triangle is known, and since the angle 52 is also known, the height or side adjacent the angle 52 can be determined by using the trigonometric equation:

$$\text{Cosine } \theta = \text{Adjacent Side/Hypotenuse.}$$

ECM 40 can therefore determine the value of the distance between pivot point 26 and point C by multiplying the hypotenuse, that is, the known distance between pivot point 26 and end portion 48, by the Cosine of angle 52. The resulting value is the distance between pivot point 26 and point C, namely, the equilibrium position at horizontal line 54. Because the position of platform 20 relative to frame 14 is already known and can be inputted into ECM 40, and because the vertical length of bracket 23 is also known and programmed into ECM 40, by adding the calculated distance between pivot point 26 and point C to the other known distances ECM 40 may determine the depth of the equilibrium position represented by horizontal line 54 (FIG. 2) relative to frame 14 at that particular spot in the body of water. Thus, as dredging apparatus 10 moves across the body of water and the equilibrium position of arm assembly 24 varies, ECM 40 can determine, record, and/or output a signal indicative of the depth of the equilibrium position of arm assembly 24 throughout the floor surface of the body of water.

It may be appreciated that the equilibrium depth position data thus determined may be recorded by ECM 40 in a memory means associated therewith, or such data may be recorded on a disk or other data storage means associated with ECM 40. In one embodiment of the present invention, such data is recorded and may be utilized for conducting dredging operations at a later time. Preferably, however, ECM 40 will emit a signal 56 indicative of the equilibrium depth to a control system associated with dredging apparatus 10, which control system would, in turn, output a signal to the dredging wheel mechanism 16 following at a known distance behind arm assembly 24 to adjust the depth of operation of the dredging wheel mechanism 16 to the equilibrium depth prior to the wheel mechanism 16 arriving at that particular location. The distance of about ten feet between arm assembly 24 and dredging wheel mechanism 16 in the preferred embodiment should provide adequate time for apparatus 10 to adjust the depth of operation of dredging wheel mechanism 16 prior to reaching the location whose equilibrium position has been determined. Other distance relationships may likewise be utilized.

INDUSTRIAL APPLICABILITY

As described herein, the method and apparatus of the present invention has particular utility in all types of dredging operations and equipment wherein it is desirable to remove sediment material having at least a minimum desirable consistency. Typically, the apparatus of the present invention will be placed in front of the dredging wheel mechanism. However, in those situations when the dredging apparatus is capable of performing a dredging operation in both the forward and reverse directions of travel, the arm assembly mechanism of the present invention would be positioned such that the arm assembly mechanism would be leading the dredge wheel, so as to determine the proper sediment depth, while the trailing arm assembly mechanism would be in a retracted position to prevent interference with the dredging process.

Although it is preferred that the equilibrium depth determination step be continuously performed by ECM 40, it is recognized and anticipated that the equilibrium depth calculation performed by ECM 40 can likewise be repeated at a predetermined interval while the dredging apparatus is in motion. This predetermined interval can be based upon a specific predetermined period of time, or such interval can be based on incremental changes in the position of the dredging apparatus, or upon some other parameter or other desirable criteria.

It is also recognized that variations to the operating steps for practicing the present invention can be made without departing from the spirit and scope of the present invention. In particular, steps could be added or some steps could be eliminated. All such variations are intended to be covered by the present invention.

As is evident from the foregoing description, certain aspects of the present invention are not limited by the particular details of the examples illustrated herein, and it is therefore contemplated that other modifications and applications will occur to those skilled in the art. It is accordingly intended that the claims shall cover all such modifications and applications that do not depart from the sprit and scope of the present invention.

Other aspects, objects and advantages of the present invention can be obtained from a study of the drawings, the disclosure and the appended claims.

What is claimed is:

1. An apparatus adapted for determining the depth of sediment material under a body of water having a minimum desirable consistency for a dredging operation, the apparatus comprising:

an arm assembly (24) having opposed end portions (30, 32), one end portion (32) of said arm assembly (24) being pivotally attached to a substantially horizontal member (20);

a plate member (34) associated with the opposite end portion (30) of said arm assembly (24), said plate member (34) having a predetermined cross-sectional area for encountering a resistance force from the sediment material located under the body of water when said plate member (34) is moved thereacross, the resistance force from the sediment material causing said arm assembly (24) to pivotally rotate relative to said substantially horizontal member (20);

force means (42) adapted to exert a biasing force on said arm assembly (24) which acts against the resistance force of the sediment material; and said arm assembly (24) achieving an equilibrium position when said biasing force equals the resistance force of the sediment material, the equilibrium position of said arm assembly determining the depth of the sediment material having a minimum desirable consistency for a dredging operation.

2. The apparatus as set forth in claim 1, further comprising:

position sensing means (36) adapted to sense the angular position of said arm assembly (24) relative to a predetermined reference orientation (37), said position sensing means (36) being operable to output a signal (38) indicative of the angular position of said arm assembly (24) relative to said predetermined reference orientation (37); and an electronic controller (40) coupled to said position sensing means (36) for receiving signals (38) therefrom, said electronic controller (40) being operable to determine the vertical distance between said horizontal member (20) and the end portion (48) of said plate member (34) when said arm assembly is in its equilibrium position.

3. The apparatus as set forth in claim 2, wherein said electronic controller (40) is operable to output a signal (56) indicative of the equilibrium position of said arm assembly (24).

4. The apparatus as set forth in claim 2, wherein said electronic controller (40) is operable to output a signal (56) indicative of the vertical distance between said horizontal member (20) and an end portion (48) of said plate member (34).

5. The apparatus as set forth in claim 2, wherein said electronic controller (40) is operable to store the value of the vertical distance between said horizontal member (20) and an end portion (48) of said plate member (34) in a memory means associated therewith.

6. The apparatus as set forth in claim 2, wherein said electronic controller (40) is operable to record the value of the vertical distance between said horizontal member (20) and an end portion (48) of said plate member (34) in a data recording means associated therewith.

7. The apparatus as set forth in claim 2, wherein said substantially horizontal member (20) is associated with a dredging apparatus (10) having a frame construction (14) and a dredging wheel mechanism (16), said horizontal member (20) being vertically adjustable relative to the frame structure (14) of the dredging apparatus (10).

8. The apparatus as set forth in claim 7, wherein said electronic controller (40) is operable to determine the vertical distance between the frame structure (14) of the dredging apparatus (10) and an end portion (48) of said plate member (34).

9. The apparatus as set forth in claim 8, wherein said electronic controller (40) is operable to output a signal (56) indicative of the vertical distance between the frame structure (14) of the dredging apparatus (10) and an end portion (48) of said plate member (34).

10. The apparatus as set forth in claim 7, wherein said electronic controller (40) is operable to output a signal (56) indicative of the equilibrium position of said arm assembly (24) relative to the frame structure (14) of the dredging apparatus (10).

11. The apparatus as set forth in claim 1, wherein the cross-sectional area of said plate member (34) is substantially triangular.

12. The apparatus as set forth in claim 1, wherein the biasing force exerted by said force means (42) is adjustable.

13. The apparatus as set forth in claim 1, wherein said force means (42) includes a compression spring member connected between said arm assembly (24) and said horizontal member (20).

14. The apparatus as set forth in claim 1, wherein said force means (42) includes a fluid actuated hydraulic cylinder connected between said arm assembly (24) and said horizontal member (20).

15. A mechanism adapted for determining the depth of sediment material under a body of water having a minimum desirable strength for a dredging operation, said mechanism being adapted for use on a dredging apparatus (10) having a frame structure (14) and a dredging wheel mechanism (16) associated therewith, said mechanism comprising:

an arm assembly (24) having opposed end portions (30, 32), one end portion (32) of said arm assembly (24) being pivotally attached to a substantially horizontal member (20);

a plate member (34) associated with the opposite end portion (30) of said arm assembly (24), said plate member (34) having a predetermined cross-sectional area for encountering a resistance force from the sediment material located under the body of water when said plate member (34) is moved thereacross, the resistance force from the sediment material causing said arm assembly (24) to pivotally rotate relative to said substantially horizontal member (20);

biasing means (42) adapted to exert a force on said arm assembly (24) which acts against the resistance force of the sediment material;

position sensing means (36) adapted to sense the angular position of said arm assembly (24) relative to a predetermined referenced orientation (37), said position sensing means (36) being operable to output a signal (38) indicative of the angular position of said arm assembly (24) relative to said predetermined reference orientation (37);

an electronic controller (40) coupled to said position sensing means (36) for receiving signals (38) therefrom;

said arm assembly (24) achieving an equilibrium position when said biasing force (42) equals the resistance force of the sediment material, the equilibrium position of said arm assembly (24) determining the depth of the sediment material having a minimum desirable strength for a dredging operation; and said electronic controller (40) being operable to determine the equilibrium position of said arm assembly (24) relative to the frame structure (14) of the dredging apparatus (10).

16. The mechanism as set forth in claim 15, wherein said electronic controller (40) is operable to output a signal (56) indicative of the equilibrium position of said arm assembly (24) relative to the frame structure (14) of the dredging apparatus (10).

17. The mechanism as set forth in claim 15, wherein said substantially horizontal member (20) is selectably vertically adjustable relative to the frame structure (14) of the dredging apparatus (10).

18. The mechanism as set forth in claim 15, wherein the force exerted by said biasing means (42) is selectable adjustable.

19. A method for determining the depth of sediment material having a minimum desirable consistency under a body of water wherein a dredging apparatus (10) is used to remove the sediment material from under the body of water, the dredging apparatus (10) having a frame structure (14) and a dredging wheel mechanism (16) associated therewith, the method comprising the following steps:

providing an arm assembly (24) having opposed end portions (30, 32);

providing a substantially horizontal member (20) for attaching to the dredging apparatus (10);

pivotally mounting said arm assembly (24) to said substantially horizontal member (20);

providing a plate member (34) associated with the opposite end portion (30) of said arm assembly (24), said plate member (34) having a predetermined cross-sectional area for encountering a resistance force from the sediment material when said plate member (34) is moved thereacross, the resistance force from the sediment material causing said arm member (24) to pivotally rotate relative to said substantially horizontal member (20);

moving said arm assembly (24) across the sediment material located under the body of water;

applying a force (42) on said arm assembly (24) opposing the resistance force exerted on said plate member (34) by the sediment material, said arm assembly (24) achieving an equilibrium position when said opposing force equals the resistance force of the sediment material, said equilibrium position determining the depth of the sediment material having a minimum desirable consistency for a dredging operation;

sensing (36) the angular position of said arm assembly (24) relative to a predetermined referenced orientation (37) when said arm assembly (24) is in its equilibrium position; and determining (40) the depth of the equilibrium position of said arm assembly (24) with respect to the frame structure (14) of the dredging apparatus (10) based upon the sensed angular position of said arm assembly (24) at its equilibrium position.

20. The method as set forth in claim 19, including the following additional step:

adjusting the depth of the dredging wheel mechanism (16) based upon the determined depth of the equilibrium position of said arm assembly (24).

* * * * *

UNITED STATES PATENT AND TRADEMARK OFFICE

CERTIFICATE OF CORRECTION

PATENT NO. : 6,357,149 B1
DATED : March 19, 2002
INVENTOR(S) : Ronnie L. Satzler It is certified that error appears in the above-identified patent and that said Letters Patent is hereby corrected as shown below:

Column 9,
Line 28, remove the word "construction" and replace with -- structure --.

Signed and Sealed this

Third Day of September, 2002

*Attest:*

*Attesting Officer*

JAMES E. ROGAN
*Director of the United States Patent and Trademark Office*